US007556124B2

(12) United States Patent
Häfliger

(10) Patent No.: US 7,556,124 B2
(45) Date of Patent: Jul. 7, 2009

(54) DEVICE FOR EVACUATING PEOPLE FROM A BUILDING

(76) Inventor: Werner Häfliger, Wissenbach 209, CH-8932 Mettmenstetten (CH)

( * ) Notice: Subject to any disclaimer, the term of this patent is extended or adjusted under 35 U.S.C. 154(b) by 680 days.

(21) Appl. No.: 10/511,299

(22) PCT Filed: Mar. 22, 2003

(86) PCT No.: PCT/EP03/03005

§ 371 (c)(1),
(2), (4) Date: Jul. 18, 2005

(87) PCT Pub. No.: WO03/086540

PCT Pub. Date: Oct. 23, 2003

(65) Prior Publication Data

US 2006/0151240 A1 Jul. 13, 2006

(30) Foreign Application Priority Data

Apr. 18, 2002 (CH) ..... 0650/02

(51) Int. Cl.
*A62B 1/20* (2006.01)

(52) U.S. Cl. ..... 182/48

(58) Field of Classification Search ..... 182/48
See application file for complete search history.

(56) References Cited

U.S. PATENT DOCUMENTS

| | | | | |
|---|---|---|---|---|
| 192,500 | A * | 6/1877 | Goble | 182/48 |
| 386,253 | A * | 7/1888 | Marcus | 193/25 R |
| 3,464,529 | A * | 9/1969 | Horsky, Jr. | 193/7 |
| 4,099,595 | A | 7/1978 | Tracy | |
| 4,122,934 | A * | 10/1978 | Nieto de Moreno | 193/32 |
| 4,398,621 | A | 8/1983 | Baker | |
| 4,595,074 | A | 6/1986 | Nordtvedt | |
| 4,778,031 | A | 10/1988 | Curiel | |
| 2003/0226713 | A1 * | 12/2003 | Baker | 182/48 |
| 2005/0161286 | A1 * | 7/2005 | Nir | 182/48 |

FOREIGN PATENT DOCUMENTS

| | | |
|---|---|---|
| DE | 201 16 626 | 2/2002 |
| GB | 1 502 188 | 2/1978 |
| GB | 2 124 168 | 2/1984 |
| JP | 61-159973 | 7/1986 |
| WO | 98/31424 | 7/1998 |

* cited by examiner

*Primary Examiner*—Alvin C Chin-Shue
(74) *Attorney, Agent, or Firm*—Wenderoth, Lind & Ponack, L.L.P.

(57) ABSTRACT

A device for evacuating people from a building (2). The device includes a part that can be placed into a functional position from a non-functional position. In the functional position, the device forms a rescue channel (29) leading from an upper floor of a building to ground level (20). The part forming the rescue channel (29) is embodied as a tube (7) which is folded together in the non-functional position. The tube extends in an essentially vertical manner with respect to the building wall (22), and braking devices are provided for the safe conveyance of people through the rescue channel (29) to ground level (20).

11 Claims, 2 Drawing Sheets

4
3
12
23
1
5
6
16
21
15
10
7
30
22
29
2
31
20
18

DEVICE FOR EVACUATING PEOPLE FROM A BUILDING

BACKGROUND OF THE INVENTION

The present invention concerns a device for evacuating people from a building.

A device of this type is known for example from DE-A-41 08 979, which discloses an inflatable, slanting rescue chute, in which a closed ring of longitudinally-extending tubes can be brought from a non-functional position by inflating the tubes into a functional position in which it forms a rescue channel leading from an upper storey of the building to ground level. This rescue chute is unsuitable for evacuation from high buildings, since there is usually too little space for the rescue chute in view of the angle of inclination necessary for the safe conveyance of people. Also, problems of flexural strength of the tube increase with the length of the slide.

The present invention is based on the problem of creating a device of the aforementioned type which enables rapid and safe evacuation even from high buildings.

SUMMARY OF THE INVENTION

Because the part forming the rescue channel is in the form of a tube which is folded together in the non-functional position, which when unfolded into the functional position is disposed essentially vertically or at a slight angle to the building wall. Braking means are provided for the safe conveyance of people through the rescue channel to ground level. The device of the invention can be used for rapid evacuation, even from very high buildings. In an especially preferred embodiment of the braking means in the form of an annular air cushion which is inflatable in the manner of an airbag on the inside of the tube, people can be conveyed, on after another, through the rescue channel which runs essentially vertically, thereby sliding through the individual air cushions, without there being any freefall.

BRIEF DESCRIPTION OF THE DRAWINGS

The invention is next explained in more detail with the aid of the accompanying drawings, in which.

DETAILED DESCRIPTION OF THE INVENTION

Figure 1:
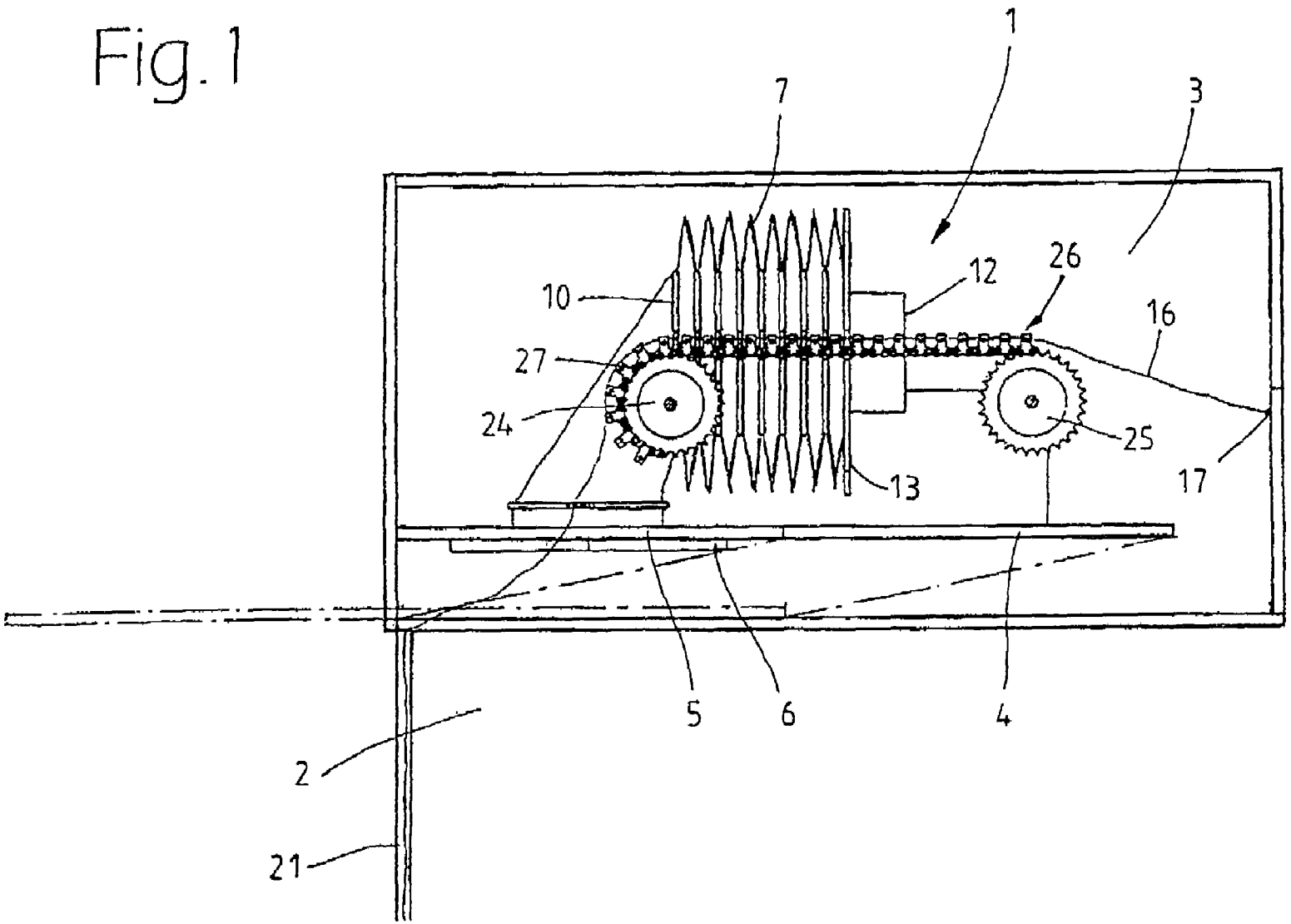
FIG. 1 shows an embodiment of a device according to the invention in a non-functional position.
Figure 2:
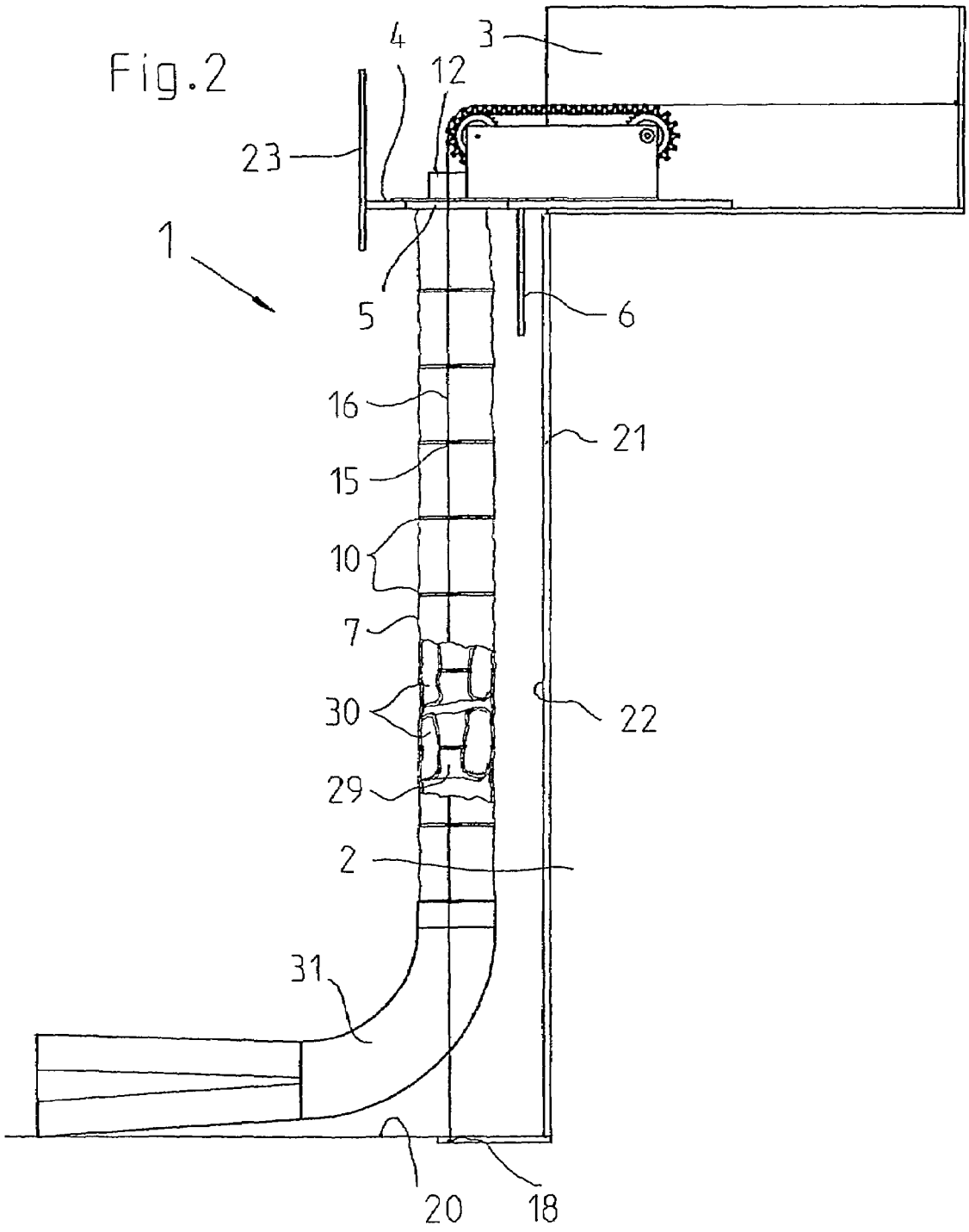
FIG. 2 is a partial sectional view of the device in a functional position.

FIGS. 1 and 2 show a device 1 for the evacuation of people from a building 2, which is housed, in a non-functional position (see FIG. 1) in an enclosure 3, which is in an upper storey of the building 2. The device 1 is thereby disposed on a plateau 4 which can be partially extended outwards from the enclosure 3 or from the building 2.

FIG. 2 shows the plateau 4 in the position projecting from the building 2, which is also indicated by a dotted line in FIG. 1. The plateau 4 is provided with a base opening 5, which is kept closed in the non-functional position by means of a flap 6, and which is disposed in the area of the plateau 4 which can be extended out of the building 2.

The device 1 comprises a tube 7 which folds together in the manner of a concertina, which is equipped with a number of transversal rings distributed over its length at a distance from each other. The transversal rings 10 are pressed close together when the tube is in the folded position, as can be seen in FIG. 1. The tube 7 is connected at one end with an entrance part 13 displaying an entry opening 12 and disposed with the other end in front of the base opening 5 of the plateau 4. The folded tube part, equipped with transversal rings 10 and the axis of the entry opening 12 in the non-functional position, are disposed parallel to the plateau 4, i.e. horizontally.

The transversal rings 10 are each provided with at least one opening, indicated in FIG. 2 by reference number 15. A tensioning rope 16 is passed through the openings 15 of the individual transversal rings 10. The rope extends between two fixed points 17, 18, one of which is disposed in the rear area of the enclosure 3 (see FIG. 1) and the other is assigned to ground level 20 (FIG. 2).

The tensioning rope 16 is passed over the upper side of a tensioning and transport device 26. The tensioning and transport device 26, resting on the plateau 4, comprises two wheels 24, 25 and a transport chain 27 driven by the wheels. The chain cooperates with the transversal rings 10 of the tube 7. In the non-functional position of the device 1 shown in FIG. 1, the tensioning rope 16 is not under tension and is advantageously passed within a groove 21 along the building wall 22. When the plateau is extended, the tensioning rope 16, which is fixed to the fixed points 17, 18, is torn out of the groove 21 and brought into an extended position approximately parallel to the building wall 22.

In order to evacuate people from a building 2 in an emergency, the plateau 4 provided in the enclosure 3, together with the tensioning and transport device 26 disposed thereon, is extended outwards into the position shown in FIG. 2. The building wall 22 at this point is formed by a wall element 23 or similar disposed on the plateau, and this wall element 23 effects an opening in the building wall when the extension of the plateau occurs. When extension occurs, moreover, the tensioning rope 16 is ripped out of the groove 21 on the building front and is tensioned between the reference points 17, 18 by the roller 24 which moves with the plateau 4.

As soon as the plateau 4 has been extended and has reached its end position, the flap 6 is also automatically pivoted down and the base opening 5 in the plateau 4 is opened, and the tube 7 falls, under the influence of gravity, downwards through the base opening 5 and unfolds itself automatically. Thereby the transversal rings 10 slide along the tensioning rope 16. Alternatively, two tensioning ropes 16 can be provided, and preferably each transversal ring 10 is provided with two opposing openings 15 for receiving the two tensioning ropes 16. The tube 7 is held fast at the upper end by the entrance part 13 resting on the plateau 4, which has been brought into this position, in which the entry opening 12 is disposed co-axially with the base opening 5, with the aid of the tensioning and transport device 26. Thus, the tube 7 which has been let down forms a rescue channel 29 leading down from the upper floor to ground level 20.

Each transversal ring 10 is assigned, on the inside of the tube 7, an annular air cushion 30 which is inflatable in the manner of an airbag, which is automatically inflated when the tube 7 is let down. The air cushions 30 form the braking means for the people being conveyed through the tube 7 and prevent any freefall in the practically vertical tube arrangement. The people entering the tube 7 through the entry opening 12 slide, one-by-one, from one air cushion 30 to the next. The elastic flexibility of the air cushions 30 in radial and axial direction allows the braked passage of people of varying heights and sizes, respectively.

At the lower end of the tube 7 there can be attached, as shown in FIG. 2, an essentially arched exit part 31, which is not equipped with any more braking means, and which facilitates a rapid exit.

Instead of the annular air cushions 30, which are inflatable in the manner of an airbag, other braking means for the safe conveyance of people are possible. For example, air blown from a fan into the tube from below could guarantee the necessary braking resistance.

The tube 7 preferably consists of a flame-resistant and heat-insulating material, so that even in the event of a fire, there is no risk to people being conveyed through the tube. Another possibility would be the application of a transparent material for better supervision of the evacuation process or windows could be provided in the tube.

An essential advantage of the device according to the invention lies in its independence from the building infrastructure, e.g. from electrical power.

The plateau 4 can advantageously form a part of a container which can be extended out of the building 2, in which the entire device is housed in the non-functional position. The container is not visible on the building 2 from the outside. Several such devices per storey and devices in several stories could be provided.

The invention claimed is:

1. A device for evacuating people from a building, the device comprising:

a container adapted to be supported on an upper level of the building, the container including a plateau that can be extended from the building;

a tube housed in a folded position in the container when in a non-functional position, wherein the tube can be moved from the non-functional position to a functional position to form a rescue channel leading from the upper level of the building to ground level; and a tensioning rope for determining the arrangement of the tube in the functional position, wherein the tube is folded together when in the non-functional position, and the tube extends in an essentially vertical manner with respect to a wall of the building when deployed to the functional position, wherein the tube is equipped with a number of transversal rings spaced from each other in a longitudinal direction of the tube, and each of the transversal rings is provided with at least one opening for permitting passage of the tensioning rope, wherein each transversal ring is provided with an annular air cushion which is inflatable in the manner of an airbag when the tube is moved to the functional position, and the air cushions function to provide for safe conveyance of people through the rescue channel to the ground level by braking transfer of the people through the rescue channel, the tensioning rope having one end attached to a fixed point in the container and another end attached to a fixed point at the ground level, a portion of the tensioning rope between the fixed points being stored within a groove along the building wall, and wherein, in the functional position of the tube, the plateau is extended, and the tensioning rope is ripped out of the groove provided along the building wall and brought into an approximately vertical position such that the tensioning rope is stretched between the fixed point in the container and the fixed point at the ground level.

2. The device according to claim 1, wherein the tube can be folded together or extended in the manner of a concertina.

3. The device according to claim 1, wherein the tube, when folded in the non-functional position, is disposed on an upper surface of the plateau.

4. The device according to claim 1, wherein the plateau includes a base opening through which the tube can unfold automatically towards the ground when the plateau is extended.

5. The device according to claim 4, wherein the tube is connected at one end with an entrance part forming an entry opening, and when the plateau is extended, the entrance part is supported by the plateau and is disposed in a position at which the entry opening is disposed coaxially with respect to the base opening.

6. The device according to claim 1, wherein, in the functional position, an arched exit part is attached to a lower end of the tube.

7. The device according to claim 1, wherein the tube is made of a flame-resistant material.

8. The device according to claim 1, wherein the tube is made of a transparent material, or the tube includes a plurality of windows.

9. The device according to claim 4, wherein the plateau includes a flap for closing the base opening in the non-functional position and automatically opening the base opening when the plateau is extended from the container.

10. The device according to claim 5, wherein the entry opening of the tube has a central axis which is in a horizontal orientation when the tube is in the non-functional position and in a vertical orientation when the tube is in the functional position.

11. The device according to claim 1, further comprising a tensioning and transport device supported on the upper surface of the plateau, the tensioning and transport device including two wheels engaged with a transport chain, wherein the transport chain cooperates with the transversal rings of the tube.

* * * * *